United States Patent [19]

Herbez

[11] 4,114,633

[45] Sep. 19, 1978

[54] CAMPING TENT FOR MOTORCYCLES AND CYCLISTS

[76] Inventor: Francois Herbez, 15, rue Turgot, 78100 Saint Germain en Laye, France

[21] Appl. No.: 742,124

[22] Filed: Nov. 15, 1976

[30] Foreign Application Priority Data

Nov. 20, 1975 [FR] France ..... 75 35514

[51] Int. Cl.[2] ..... A45F 1/00

[52] U.S. Cl. ..... 135/1 A; 150/52 K; 296/136

[58] Field of Search ..... 135/1 R, 1 A, 3 A, 4 A, 135/5 A, 7; 296/23 A, 136; 150/52 K

[56] References Cited

U.S. PATENT DOCUMENTS

| | | | |
|---|---|---|---|
| 527,549 | 10/1894 | Frankenberg | 135/7 |
| 1,290,824 | 1/1919 | Wittmann | 135/1 A |
| 1,483,741 | 2/1924 | Moffett | 135/1 A |
| 1,622,435 | 3/1927 | Frazee | 135/1 R |
| 2,246,813 | 6/1941 | Preston | 135/4 A |
| 3,020,919 | 2/1962 | Crump | 135/1 A |
| 3,536,083 | 10/1970 | Reynolds | 135/1 R |
| 3,884,523 | 5/1975 | Allen | 135/7 |
| 3,913,968 | 10/1975 | Luppeus | 135/5 A |

FOREIGN PATENT DOCUMENTS

| | | | |
|---|---|---|---|
| 513,435 | 10/1939 | United Kingdom | 150/52 K |

OTHER PUBLICATIONS

"Now You Can Pedal Your Tent", Washington Post Newspaper, Aug. 1977.

*Primary Examiner*—Price C. Faw, Jr.
*Assistant Examiner*—Conrad L. Berman
*Attorney, Agent, or Firm*—Michael J. Striker

[57] ABSTRACT

A tent which serves both as a sleeping unit and as a shelter for a two-wheeled vehicle such as a bicycle or motor-cycle is designed in the form of a penthouse mounted against one of the sides of the vehicle. A vertical wall extends alongside the vehicle and the double roof of the tent is designed to cover the vehicle so as to form an awning on the other side of this latter or to extend downwards along the side opposite to the tent.

12 Claims, 9 Drawing Figures

FIG. 3
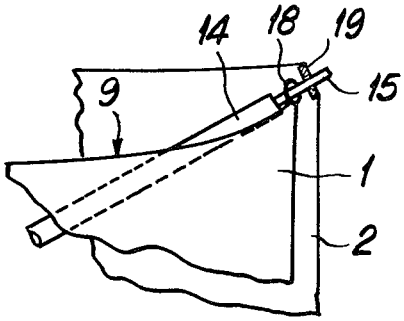
FIG. 4
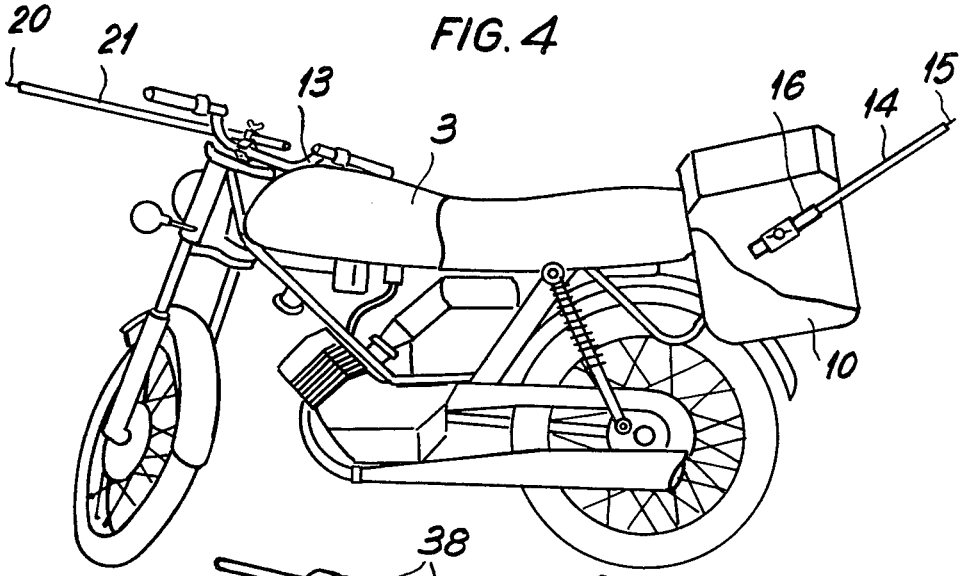
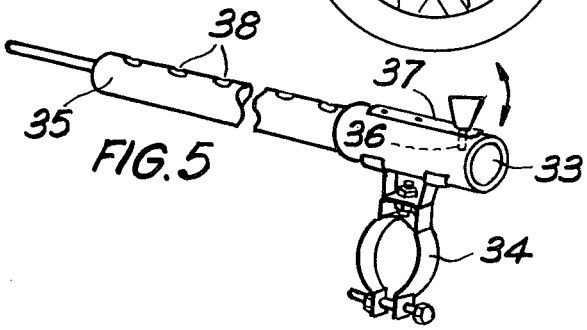
FIG. 5

CAMPING TENT FOR MOTORCYCLES AND CYCLISTS

This invention relates to a camping tent which is specially intended for motor-cyclists and cyclists, the tent being designed to serve both as a sleeping tent for these users and at the same time as a shelter for protecting the motor-cycle or bicycle against bad weather conditions.

In point of fact, camping tents of the type in use at the present time do not lend themselves to the practical requirements mentioned above. In actual practice, motor-cyclists or cyclists who make use of tents of this type are separated from their vehicle which is consequently liable to be stolen during the night without their knowledge. Furthermore, no shelter is provided for the bicycle or motor-cycle unless a covering is supplied in addition to the sleeping tent. Moreover, conventional camping tents are relatively heavy and cumbersome, especially by reason of the fact that they have a metal frame for supporting the tent fabric.

The tent in accordance with the invention is so designed as to be associated with a bicycle or motor-cycle and to be supported by this latter without entailing the need for a supporting framework. This tent is accordingly designed in the form of a penthouse which can be mounted against one side of a bicycle or motor-cycle and has a vertical wall extending alongside this latter, the double roof of said tent being capable of covering said bicycle or motor-cycle either by forming an awning on the other side of this latter or by extending downwards along the side opposite to the tent.

Under these conditions, the tent under consideration forms both a sleeping tent for the users of a bicycle or motor-cycle and a shelter for the protection of this latter while nevertheless keeping the bicycle or motor-cycle outside the sleeping tent proper. The occupants of the tent are in fact separated from the bicycle or motor-cycle by the vertical wall of the tent which is mounted against one side of this latter.

Further particular features and advantages of the tent in accordance with the invention will in any case be brought out by the description which now follows below, reference being made to the accompanying drawings which are given solely by way of illustration, and in which:

FIG. 3 is a fragmentary vertical sectional view of a detail of the mode of attachment of the tent and of the double roof;

FIG. 4 is a view in elevation of a motor-cycle as equipped for receiving the tent in accordance with the invention;

FIG. 5 is a perspective view of an alternative form of construction showing some of the fastening means provided on said motor-cycle for the purpose of securing the tent in accordance with the invention to this latter;

Figure 1:
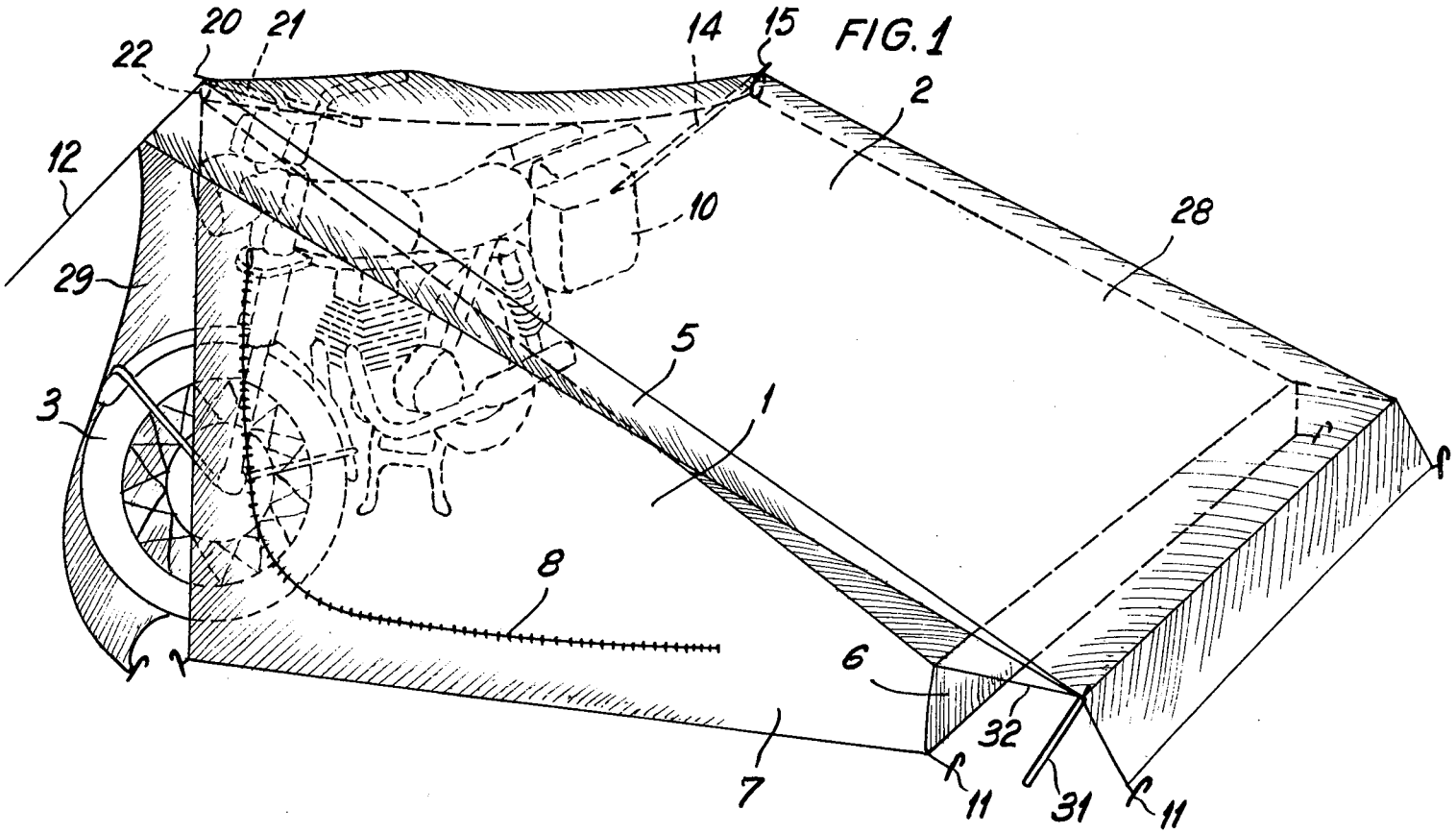
FIG. 1 is a perspective view of the tent as shown in the position of utilization.

The tent under consideration comprises a tent 1 proper and a double roof 2 which covers this latter. The inner tent 1 assumes the shape of a penthouse which can be placed against one of the sides of a motor-cycle 3. To this end, said inner tent has a vertical section of triangular or trapezoidal shape. The tent therefore has a vertical wall 4 having a height which is substantially equal to that of the motor-cycle 3 and a length which can also be of the same order as that of said motor-cycle.

The inclined face 5 can extend downwards to the ground or to a vertical wall 6 of small height and located at the end remote from the motor-cycle. Said tent is closed at both ends by vertical walls 7 of triangular or trapezoidal shape. At least one of said vertical walls has a door which gives access to the tent and is formed by an opening, the edges of which are provided with suitable closure means such as, for example, a slide or zip fastener 8, or else hook-and-eye fasteners, press-studs and the like.

The top edge 9 of the tent 1 is secured at its extremities to the frame of the motor-cycle 3 or of accessory motor-cycle elements which can be specially designed for the purpose of mounting the tent. Preferably, the tent as well as the double roof 2 can be designed so that they can be packed in a saddle-bag 10 which is intended to be fixed on the luggage carrier or on the rear portion of the motor-cycle. Said saddle-bag can accordingly receive all the tent components, that is to say not only the inner tent 1 and its double roof but also the tent pegs 11, the guy ropes 12 and all the other accessories with the exception, however, of the system for fastening the tent on the front portion of the motor-cycle; this fastening system can be permanently mounted on the handlebar 13 of the motor-cycle or on any other portion of the front end of the frame.

The top edge 9 of the tent 1 is attached at its opposite end to a supporting member which is carried by the saddle-bag 10. Said supporting member can consist of a tube 14 having a pointed end 15. Said tube is detachably mounted at the end of another tube 16 which is stationarily fixed within the interior of the saddle-bag 10. In fact, said tube 16 is secured against the internal face of the rear wall of the saddle-bag 10 (as shown in FIG. 4) by means of a fastening-collar 17. The arrangement is such that the tube 16 does not project beyond the saddle-bag and therefore does not cause any hindrance.

At the time of erection of the tent, it is only necessary to adapt the tube 14 which is thus placed in an upwardly inclined position. In point of fact, provision is made on the corresponding top corner of the inner tent 1 for an outer ring 18 which is intended to be passed over the pointed end 15 of the tube 14 (as shown in FIG. 3). So far as the corresponding corner of the double roof 2 is concerned, this latter is provided with an eyelet 19 which is also intended to be engage over the pointed end 15.

By virtue of the system adopted for fastening the tube 16 within a collar 17, it is possible to adjust the height of the pointed end 15 of the tube 14 in order to ensure perfect erection both of the tent and of the double roof. At the front end of their top edge, the tent 1 and the double roof 2 are attached to the pointed end 20 of a tube 21 which virtually replaces the vertical pole of a normal tent. This fastening operation is carried out in the same manner as at the rear end since the corresponding corner of the tent is provided with an outer ring 22 which is fitted on the pointed end 20 whilst the double roof is provided with an eyelet 23 which is also engaged on said pointed end.

The tube 21 which serves as a supporting element at the front end is removably fixed on the handlebar 13 of the motor-cycle 3 by means of a fastening system comprising two collars 25 and 26 which are capable of relative pivotal motion. The first fastening-collar is fixed on the handlebar 13 whilst the second fastening-collar is capable of receiving the tube 21. The useful length of said tube can thus be adjusted at will by displacing it in sliding motion within the collar 26. Moreover, it is possible to modify the orientation of the tube by pivotal motion with respect to the collar 25, a nut 27 being provided for locking the complete assembly in the desired position.

The top edge 9 of the inner tent can be stiffened by means of a cable and a suitable tensioning system. This cable can be of any suitable material such as a metal cable, a rope of synthetic material and so forth. However, the cable can also be replaced by an overpleat at the hem of the tent fabric.

Figure 2:
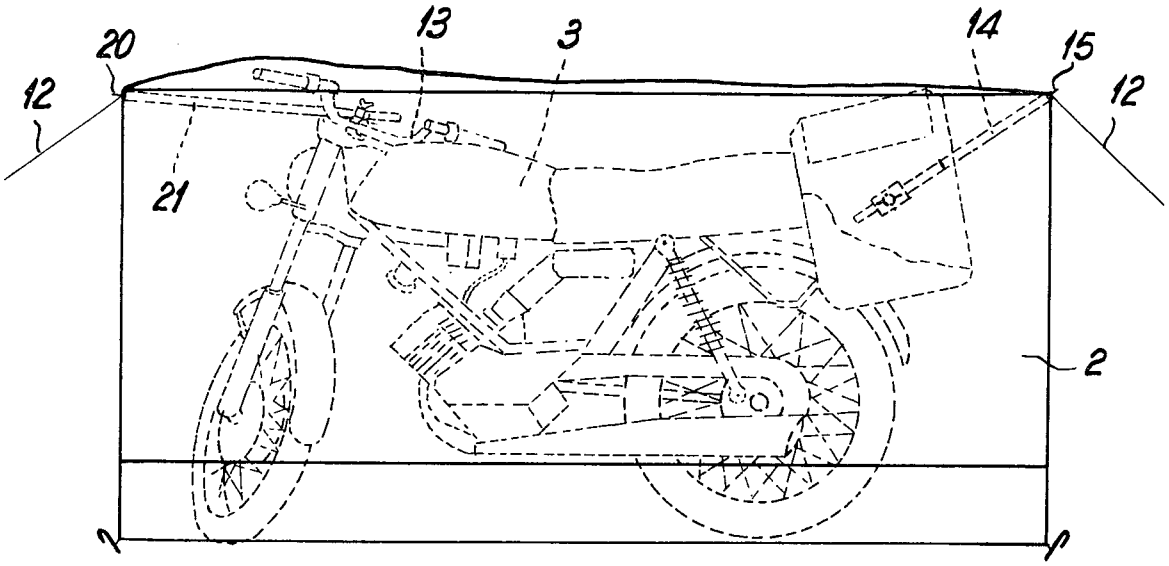
FIG. 2 is a corresponding view in side elevation.
Figure 6:
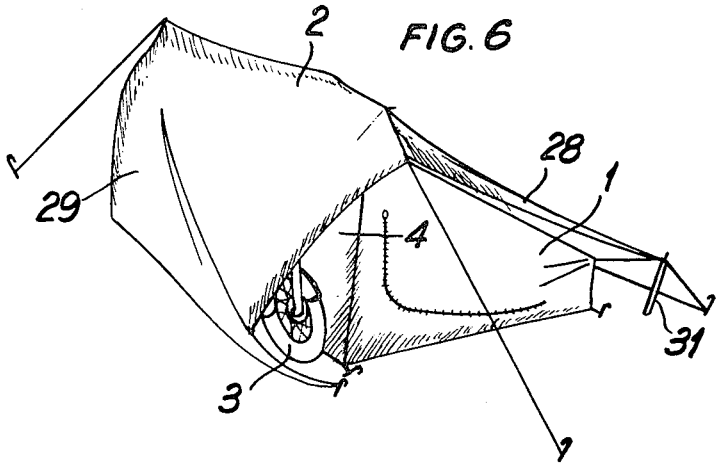
FIGS. 6 to 9 are diagrammatic views in perspective showing a number of possible modes of conversion of the tent in accordance with the invention.

It is readily apparent that, prior to erection of the tent in accordance with the invention, the motor-cycle must be fixed in position on the ground by means of the stand with which it is normally equipped for this purpose. The inner tent 1 can then be installed against the right or left side of the motor-cycle as shown in FIGS. 1 and 2. So far as the double roof 2 is concerned, it has two panels 28 and 29 respectively and the surface area of one of these latter, namely the panel 28 in this instance, is sufficient to cover the inner tent 1 completely. In regard to the second panel 29, this latter is intended to be placed on the other side of the motor-cycle. This panel is of sufficient area to extend down to the ground, thus protecting the motor-cycle on the side considered. Said panel can then be anchored to the ground by means of pegs and by engagement of its bottom edge beneath the wheels of the motor-cycle as shown in FIGS. 1 and 6.

Figure 7:
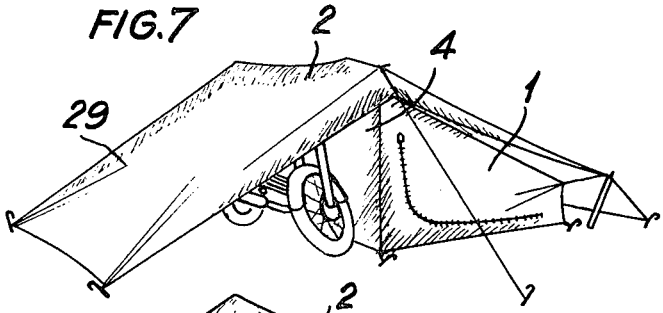

However, as illustrated in FIG. 7, said panel 29 can also be stretched slantwise in a similar manner to the panel 28, in which case it also serves to protect the motor-cycle against the effects of bad weather. In this case, users of the tent have at their disposal a storage space in which a certain number of objects can be placed under cover and are thus unexposed to bad weather.

Figure 8:
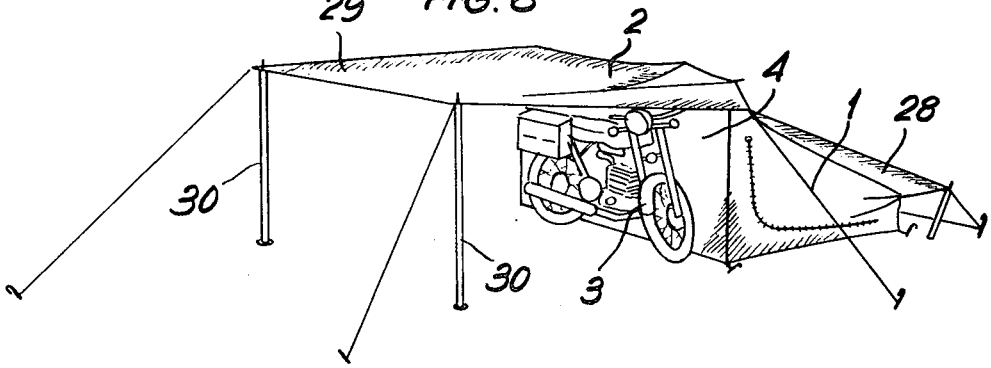

However, as shown in FIG. 8, it is also possible to lift the second panel 29 of the double roof so as to form an awning by securing the outer corners of the panels to the upper ends of two supporting poles 30 constituted by interassembled tube sections. Thus the users of the tent are provided with a daytime shelter. This shelter can also serve as a kitchen corner or for any other requirement.

Figure 9:
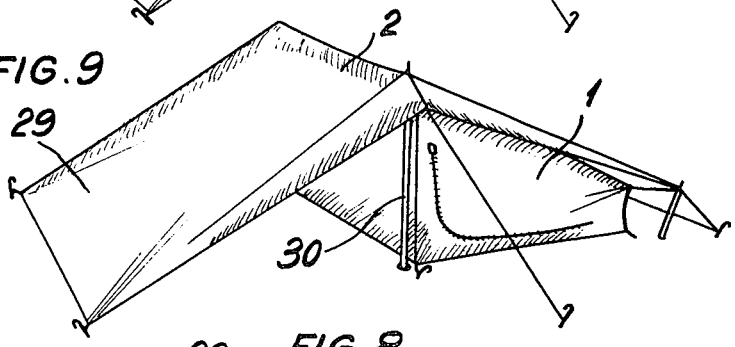

The two poles 30 which are provided for lifting the panel 29 of the double roof so as to form an awning can also be employed for supporting the tent 1 and the double roof 2 instead of the frame of the motor-cycle 3 as shown in FIG. 9. This makes it possible to take the motor-cycle out during the day. Under these conditions, the motor-cycle can accordingly be employed without entailing the need to dismantle the tent.

The inner tent 1 can have a sufficient volume to offer one or two sleeping areas with or without awning and with or without storage space. This tent can have a groundsheet which may or may not be bonded to the other walls. The fabric panel constituting the vertical wall 4 which is placed alongside the motor-cycle can be fireproofed in order to afford resistance to the heat of the motor-cycle engine and other hot portions. If so required, however, said vertical wall could be provided with one or a number of openings for allowing the heat of the engine to penetrate inside the tent 1; such openings would also enable the occupants of the tent to gain access to the saddle-bag 10 which is fixed on the side of the motor-cycle.

The tent 1, one side of which is secured to the motor-cycle frame, can be fitted on the opposite side with guy-ropes 12 attached to pegs 11 which are fixed in the ground. However, provision can also be made for any other suitable system such as, for example, small poles 31 from which the corners of the tent roof are suspended by means of tensioning cables 32, said poles being also employed for supporting the corresponding corners of the double roof.

By virtue of its design concept, the tent according to the invention offers the following main advantages:

(a) said tent constitutes a camping shelter which provides sleeping accommodation for one or a number of motor cyclists and ensures that their motor-cycle is not liable to be stolen during the night without their knowledge;

(b) at the same time, said tent provides a shelter for the protection of both motor-cycle and luggage against unfavorable weather conditions;

(c) said tent can be installed without entailing any need to unload the items of luggage which are placed on the motor-cycle and which are protected by the double roof;

(d) ease of erection and dismantling of the tent and the small bulk of the tent components after disassembly;

(e) momentary heating of the sleeping area by means of the heat given off by the motor-cycle engine;

(f) the possibility of a complementary shelter on the side opposite to the tent 1 by lifting the second panel 29 of the double roof so as to form an awning (as shown in FIG. 9).

However, it is also possible to install beneath the second panel 29 of the double roof a second sleeping tent which is similar to the tent 1. Moreover, this second tent can also be secured to the corresponding side of the motor-cycle.

As can readily be understood, the tent in accordance with the invention is not limited to the example of construction described in the foregoing in which different modifications can accordingly be made. Thus, the means for fastening the ends of the top edge of the tent and of the double roof on the motor-cycle frame can be modified. Moreover, FIG. 5 illustrates another form of construction of the means for fastening the front end of the top edge of the tent and of the double roof.

In this form of construction, provision is made for a tube section 33 which is stationarily fixed on the motor-cycle handlebar 13 by means of a fastening-clamp 34 on which said tube section is pivotally mounted. The tube section can be fitted with another tube 35 which is intended to replace the tube 21 described earlier. Said tube 35 is capable of sliding within the tube section 33 but can be locked in position within this latter in a number of different positions by means of a locking stud 36 carried by a leafspring 37. Said locking stud can be engaged in any one of a series of holes 38 which are formed in the tube 35.

It is readily apparent that the use of the tent under consideration is not limited to motor-cyclists alone. In fact, the tent is also suitable for cyclists, in which case the inner tent 1 can be installed against one of the sides of a bicycle after this latter has been fixed in a vertical position, for example by means of a retractable stand for supporting the bicycle on the ground. In this case, the double roof 2 is disposed in the same manner as before, that is to say partly above the inner tent and partly underneath the corresponding bicycle which is thus protected from inclement weather conditions.

I claim:

1. The camping tent to be associated with a vehicle, comprising an inner portion having and inner first roof section and a wall section and adapted to form, in an erected position of the tent, a closed first shelter for a user with said wall extending in an upright direction; an outer roof portion connected with said wall section and including a second roof section which extends in said erected position, from one side of said upright wall section in a first direction and above said first roof section of said inner portion so as to cover said inner portion from above and thereby to protect said first shelter for a user, and a third roof section which extends in said erected position from the opposite side of said upright wall section in a second direction which is opposite to said first direction and defines therewith a second shelter adapted to accommodate the vehicle and located outside of said first shelter for a user, said wall section and said inner portion each having a top edge extending in a third direction which is transverse to said first and second directions and having two end portions spaced from one another in said third direction; and mounting means in at least one of said top edges, arranged for mounting the tent on the vehicle so that the tent assumes its erected position in which it is supported by the vehicle so that said first shelter for the user is separated from said second shelter for the vehicle by said upright wall section, and the vehicle cannot be withdrawn from the tent by an unauthorized person without collapsing the tent, said mounting means including first and second mounting means which are spaced from one another in said third direction and arranged to support said first and second end portions of said one top edge, respectively, and to tension the tent in said third direction which is transverse to said first and second directions.

2. The camping tent as defined in claim 1, wherein said third roof section of said outer roof portion is movable so as to define said second shelter in a form of an awning.

3. The camping tent as defined in claim 1, wherein said other third roof section of said outer roof portion is movable so as to extend downwardly when the tent is erected.

4. The camping tent as defined in claim 4; and further comprising erection elements mountable on the vehicle and arranged for interacting with said mounting means so as to support said top edge.

5. The camping tent adapted to be associated with a vehicle having a carrier bag secured to a rear end of the vehicle, as defined in claim 1, wherein said top edge has one end, said first mounting means being provided at one end portion of said top edge and attachable to the carrier bag of the vehicle, said inner portion and said roof portion being accommodatable in the carrier bag of the vehicle when the tent is in a folded condition.

6. The camping tent as defined in claim 5; and further comprising an additional element mountable on the carrier bag of the vehicle and connectable with said first mounting means.

7. The camping tent as defined in claim 6, wherein said first mounting means is a tube.

8. The camping tent as defined in claim 1; and further comprising a fastening system attachable to a front portion of the vehicle, said second mounting means being provided in another end portion of said top edge and attachable to said fastening system.

9. The camping tent as defined in claim 8, wherein the vehicle has a handlebar, said fastening system being attachable to a handlebar of the vehicle.

10. The camping tent as defined in claim 8, wherein said second mounting means includes a tube receivable in said fastening system and adapted to support the corresponding end of said top edge, said tube being adjustable in its useful length and orientation.

11. The camping tent as defined in claim 1; and further comprising substantially upright supporting elements each having two spaced ends, one end of each of said supporting elements abutting against and supporting said inner portion and said roof portion when the tent is erected, independently from the vehicle so that the vehicle can be removed from said second shelter after disconnecting the tent from the vehicle but without dismounting of the tent.

12. The camping tent as defined in claim 11, wherein said supporting elements are two poles.

* * * * *